US008257451B2

(12) United States Patent
Allen et al.

(10) Patent No.: US 8,257,451 B2
(45) **Date of Patent: *Sep. 4, 2012**

(54) PREPARATION OF FUEL USABLE IN A FOSSIL-FUEL-FIRED SYSTEM

(75) Inventors: Gary W. Allen, Greensboro, NC (US); John T. Joyce, Jr., Beckley, WV (US)

(73) Assignee: Evonik Stockhausen, LLC, Greensboro, NC (US)

( * ) Notice: Subject to any disclaimer, the term of this patent is extended or adjusted under 35 U.S.C. 154(b) by 437 days.

This patent is subject to a terminal disclaimer.

(21) Appl. No.: 12/577,317

(22) Filed: Oct. 12, 2009

(65) Prior Publication Data

US 2010/0024697 A1 Feb. 4, 2010

Related U.S. Application Data

(62) Division of application No. 10/818,229, filed on Apr. 2, 2004, now abandoned.

(60) Provisional application No. 60/462,552, filed on Apr. 11, 2003.

(51) Int. Cl.
*C10L 5/14* (2006.01)
*C10L 5/00* (2006.01)

(52) U.S. Cl. ..... 44/553; 44/620

(58) Field of Classification Search ..... 44/553, 44/620

See application file for complete search history.

(56) References Cited

U.S. PATENT DOCUMENTS

| | | | | |
|---|---|---|---|---|
| 2,622,671 | A | 12/1952 | Johnson | 431/3 |
| 2,874,802 | A | 2/1959 | Gustafsson, et al. | |
| 3,444,668 | A | 5/1969 | Masuda | |
| 3,564,818 | A | 2/1971 | Lasky | |
| 3,709,977 | A | 1/1973 | Villiers-Fisher | |
| 3,780,500 | A | 12/1973 | Clemens et al. | |
| 3,805,493 | A | 4/1974 | Kennedy et al. | |
| 3,916,025 | A | 10/1975 | Kunin | |
| 3,933,028 | A | 1/1976 | Laud et al. | |
| 4,024,407 | A | 5/1977 | Meric et al. | |

(Continued)

FOREIGN PATENT DOCUMENTS

FR 2722113 A 1/1996

(Continued)

OTHER PUBLICATIONS

Municipal solid wastes in the United States: 1999 Facts and Figures, Jul. 2001, EPA pp. 62,64,66,41,43, and 32.

(Continued)

*Primary Examiner* — Cephia D Toomer

(74) *Attorney, Agent, or Firm* — Smith Moore Leatherwood LLP; Clara R. Cottrell

(57) ABSTRACT

A fossil-fuel-fired system, which includes an emissions-control-agent dispenser, a furnace, an emissions monitor and, optionally, a controller, is disclosed. The emissions-control-agent dispenser provides a prescribed amount of organic-emissions-control agent, such as, for example, an opacity-control agent to the fossil-fuel-fired system. The furnace includes an exhaust communicating with the atmosphere. The emissions monitor is capable of measuring at least one property of the flue-gas communicated through the exhaust to the atmosphere. For example, when an organic-emissions-control agent is an opacity-control agent, the emissions monitor has the capability of at least measuring opacity. When included, the controller communicates with at least the emissions-control-agent dispenser and the emissions monitor.

8 Claims, 5 Drawing Sheets

U.S. PATENT DOCUMENTS

| | | | | |
|---|---|---|---|---|
| 4,066,364 | A | 1/1978 | Emerson | |
| 4,225,243 | A | 9/1980 | Typpo | |
| 4,501,205 | A | 2/1985 | Funk | 110/347 |
| 4,544,273 | A | 10/1985 | Berndt | |
| 4,589,775 | A | 5/1986 | Milhous, Jr. et al. | |
| 4,640,205 | A | 2/1987 | Brannstrom | |
| 4,650,598 | A | 3/1987 | Roberts et al. | |
| 4,652,755 | A | 3/1987 | Solomon et al. | |
| 4,677,426 | A | 6/1987 | Dattilo | |
| 4,710,365 | A | 12/1987 | Gebhard et al. | |
| 4,736,692 | A | 4/1988 | Eldh et al. | |
| 4,913,068 | A | 4/1990 | Brännström | |
| 4,993,838 | A | 2/1991 | Tresouthick et al. | |
| 5,048,431 | A | 9/1991 | Landreth et al. | 110/343 |
| 5,061,259 | A | 10/1991 | Goldman et al. | |
| 5,171,781 | A | 12/1992 | Farrar et al. | |
| 5,230,871 | A | 7/1993 | Martin et al. | |
| 5,273,209 | A | 12/1993 | MacArthur et al. | 237/18 |
| 5,306,867 | A | 4/1994 | Connole et al. | 174/23 R |
| 5,320,052 | A | 6/1994 | Spokoyny et al. | 110/345 |
| 5,340,214 | A | 8/1994 | Juzwiak | 366/292 |
| 5,342,418 | A | 8/1994 | Jesse | 44/589 |
| 5,350,799 | A | 9/1994 | Woodrum et al. | 525/54.3 |
| 5,363,199 | A | 11/1994 | Victor et al. | |
| 5,363,778 | A | 11/1994 | Kmiotek et al. | 110/232 |
| 5,374,992 | A | 12/1994 | Pye et al. | |
| 5,383,612 | A | 1/1995 | Williams | |
| 5,404,228 | A | 4/1995 | McGowan | |
| 5,409,626 | A | 4/1995 | Muth | |
| 5,424,842 | A | 6/1995 | Poorman | |
| 5,536,429 | A | 7/1996 | Bennett et al. | |
| 5,643,342 | A * | 7/1997 | Andrews | 44/530 |
| 5,658,547 | A | 8/1997 | Michalak et al. | 423/243.08 |
| 5,831,730 | A | 11/1998 | Traina et al. | |
| 5,848,728 | A | 12/1998 | Ricciardi et al. | |
| 5,852,398 | A | 12/1998 | Helman | |
| 5,992,336 | A | 11/1999 | Ramme | |
| 6,050,656 | A | 4/2000 | Farahi et al. | |
| 6,325,001 | B1 | 12/2001 | Sheldon | |
| 6,338,305 | B1 | 1/2002 | McHenry et al. | |
| 6,488,740 | B1 | 12/2002 | Patel et al. | |
| 6,597,799 | B1 | 7/2003 | Pfaff et al. | |
| 6,613,110 | B2 | 9/2003 | Sanyal | |
| 6,790,245 | B2 | 9/2004 | Wolff et al. | |
| 2002/0088170 | A1 | 7/2002 | Sanyal | |
| 2002/0117563 | A1 | 8/2002 | Lulewicz | |
| 2002/0184817 | A1 | 12/2002 | Johnson et al. | |

FOREIGN PATENT DOCUMENTS

| | | | |
|---|---|---|---|
| GB | 968330 | A | 9/1964 |

OTHER PUBLICATIONS

"Baby Diaper Secret," web page, copyright Apr. 2009, pp. 1-2, http://www.stevespanglerscience.com/content/experiment/00000064.

Fredric L. Buchholz, "Absorbency and Superabsorbency," copyright 1998, pp. 1-17, Modern Superabsorbent Technology, John Wiley & Sons, Inc., Wiley-VCH, New York, USA.

Sieve Micron Size Comparison Table, web page, copyright Apr. 2009, Rufford Knowledge Base, http://www.rufford.com/technical/mesh2microns.com.

"Water Absorbing Crystals," web page, copyright Apr. 2009, pp. 1-3, http://www.stevespanglerscience.com/experiment/00000057.

"Water Jelly Crystals," web page, copyright Apr. 2009, pp. 1-2, http://www.stevespanglerscience.com/content/experiment/water-jelly-crystals-superabsorbent-polymers.html.

"Who is Steve Spangler?" web page, copyright Apr. 2009, pp. 1-2, http://www.stevespanglerscience.com/who-is-steve-spangler.html.

Babcock & Wilcox, Steam/Its Generation and Use, book, 1978, pp. 35-1 through 35-26, 39th Edition, Babcock & Wilcox 161 East 42nd Street, New York, N.Y. 10017.

Patent Cooperation Treaty Partial International Search (IS date Oct. 10, 2004 in PCT/US2004/009800.

Babcock & Wilcox, The Pulverizer of Choice, journal, 2002, pp. 3-8, Babcock & Wilcox 161 East 42nd Street, New York, N.Y. 10017.

Babcock & Wilcox, Internal Recirculation-Circulating Fluidized-Bed Boilers, journal, pp. 1-8, Babcock & Wilcox 161 East 42nd Street, New York, N.Y. 10017.

Criepi News 355, Developing Pulverized Coal Combustion Technology for Sub-bituminous Coal, pamphlet, 2002, pp. 1-4, Central Research Institute of Electric Power Industry.

Babcock & Wilcox, Babcock & Wilcox CFB Boilers—Design and Experience, symposium, 2001, pp. 1-9, BR-1711, Babcock & Wilcox 161 East 42nd Street, New York, N.Y. 10017.

D.K. McDonald and D.A. Madden, B&W's Advanced Coal-Fired Low Emission Boiler System Commercial Generating Unit and Proof-of-Concept Demonstration, symposium, 1997, pp. 1-9, BR-1648, Babcock & Wilcox 161 East 42nd Street, New York, N.Y. 10017.

Babcock & Wilcox, Clean Environment Development Facility—Leading the Way to a Cleaner Environment, journal, 2000, pp. 1-8, Babcock & Wilcox 161 East 42nd Street, New York, N.Y. 10017.

J.B. Kitto, Technology Development for Advanced Pulverized Coal-Fired Boilers, symposium, 1996, pp. 1-9, BR-1626, Babcock & Wilcox 161 East 42nd Street, New York, N.Y. 10017.

Babcock & Wilcox, CFB Combustion of High-Ash Ukrainian Anthracite—Pilot Testing and Design Implications, symposium, 1997, BR-1634, pp. 1-10, Babcock & Wilcox 161 East 42nd Street, New York, N.Y. 10017.

D.L. Kraft, Bubbling Fluid Bed Boiler Emissions Firing Bark & Sludge, symposium, 1998, BR-1661, pp. 1-6, Babcock & Wilcox 161 East 42nd Street, New York, N.Y. 10017.

S.Kavidass, D.J. Walker, and G.S. Norton, Jr., IR-CFB Repowering: A Cost-Effective Option for Older PC-Fired Boilers, symposium, 1999, pp. 1-9, BR-1687a, Babcock & Wilcox 161 East 42nd Street, New York, N.Y. 10017.

J.F. Cronin, From Liquor to Sludge-Conversion of a Recovery Boiler to a Bubbling Fluid Bed, symposium, 1999, pp. 1-8, BR-1675, Babcock & Wilcox 161 East 42nd Street, New York, N.Y. 10017.

F. Belin, M. Maryamchik, D.J. Walker, and D.L. Wietzke, Babcock & Wilcox CFB Boilers—Design and Experience, symposium, 2001, pp. 1-9, BR-1711, Babcock & Wilcox 161 East 42nd Street, New York, N.Y. 10017.

Babcock & Wilcox, Bubbling Fluidized Bed Boilers, pamphlet, 1999, pp. 1-6, Babcock & Wilcox 161 East 42nd Street, New York, N.Y. 10017.

Babcock & Wilcox, 200 MW CFB Boiler Burning High-Ash Anthracite, symposium, 1996, pp. 1-9, BR-1629, Babcock & Wilcox 161 East 42nd Street, New York, N.Y. 10017.

Enviroment & Safety Library, Compliance with Opacity Standards, website, 2004, 1-5, http://www.bna.com/corp/index.html#V.

Stockhausen, Inc., Bleaching & Water Compounds, pamphlet, 2003, pp. 1-32, Stockhausen, Inc. Post Office Box 1949, Beckley, W.V. 25802.

Stephen K. Norfleet and William R. Roberson, Part 75 CEMS Equipment—What's Everyone Using? A Look at Current Trends in CEMS Providers, symposium, 2003, pp. 1-17, RMB Consulting & Research, Inc. 5104 Bur Oak Circle, Raleigh, N.C. 27612.

World Bank, Coal Characteristics, website, 2004, pp. 1-4, http://www.worldbank.org/html/fpd/em/power/sources/coal¯char.stm.

Land Instruments International, CEM Systems, website, 2004, pp. 1-4, http://www.landinst.com/comb/products/cem.html.

Fredric L. Buchholz and Andrew T. Graham, Analysis and Characterization of Superabsorbent Polymers, book, 1998, p. 146-147, John Wiley & Sons, Inc., 605 Third Avenue, New York, N.Y. 10158-0012.

ASTM International, Standard Test Methods for Particle Size (Sieve Analysis) of Plastic Materials, 2004, website.

Steve Charlson & Brian Taylor, Bubbling Fluidized Bed Installation Capitalizes on Sludge, symposium, 1999, pp. 1-8, BR-1673, Babcock & Wilcox 161 East 42nd Street, New York, NY 10017.

Nucla CFB Demonstration Project, website, Last Modified: Friday, Jan. 23, 2004, pp. 1-5 and figure, http://www.netl.doe.gov/cctc/factsheets/nucla/nuclademo.html.

International Search Report mailed on Feb. 14, 2005 in connection with PCT/US2004/009800.

Written Opinion of the International Searching Authority mailed on Feb. 14, 2005 in connection with PCT/US2004/009800.

Stockhausen, Inc., Bleaching & Water Chemicals, pamphlet, 2003, pp. 1-2, Stockhausen, Inc. Post Office Box 1949, Beckley, WV 25802.
George S. Brady, Materials Handbook, book, 1963, pp. 432-433, 9th Edition, McGraw-Hill Book Company Inc., New York.
ASM International, Handbook Committee, Engineered Materials Handbook: Engineering Plastics, book, 1988, pp. 497-500, vol. 2, ASM International, Materials Park, OH.
Jacqueline I. Kroschwitz, Concise Encyclopedia of Polymer Science and Engineering, book, 1990, pp. 396-397, 2nd Edition, Wiley InterScience of John Wiley & Sons, Inc., Hoboken, NJ.
A Guide for Evaluating Dry Solids Feeding Equipment, Copyright 1991, pp. 1-6, Acrison, Inc., Moonachie, NJ, USA.
Acrison Model 105 Volumetric Feeder with Optional Hoppers, Engineering Drawing 105-1-7602, Copyright 2003, Acrison, Inc., Moonachie, NJ, USA.
Acrison Standard Model 105 Volumetric Feeder Series (Models 105, 105X and 105Z), Engineering Drawing 105-1-5193, Copyright 2003, Acrison, Inc., Moonachie, NJ, USA.
Acrison Super Absorbent Polymer Applications: SAPplicator Systems, Copyright 2006-2009, www.acrison.com/pages/absorbent_hygienic_products.html, Acrison, Inc., Moonachie, NJ, USA.
Acrison Volumetric Feeders Models 105 and 140 Series—for Dry Solids, Copyright 2005, pp. 1-6, Acrison, Inc., Moonachie, NJ, USA.
Acrison's SAP Applicators—Applicators for the manufacture of absorbent hygiene products, Copyright 1997-2003, www.acrison.com_sap.htm, Acrison, Inc., Moonachie, NJ, USA.
United States Environmental Protection Agency, Solid Waste and Emergency Response (5305W), "Municipal Solid Waste in the United States: 1999 Facts and Figures," Copyright 2001, pp. 1-136.
Midwest Industrial Supply, Inc., Freeze-Free Problems with Coal Freezing?, article, Copyright 1998, pp. 1-4, MW0475-98, Midwest Industrial Supply, Inc., Canton, Ohio.
Midwest Industrial Supply, Inc., B-Free Side Release Agent, article, Copyright 2000, pp. 1-4, Midwest Industrial Supply, Inc., Canton, Ohio.
Christopher F. Blazek, John Finch, Andy Miller, Danelle Vorster, and Asghar Eskandani, Emission Control, article, Copyright 2002, pp. 1-6, World Coal.
Benetech, Inc., Benetech, Inc. Dry Sorbent Injection (DSI) and Wet Fuel Handling: Solutions to Minimize Plugging, articles, pp. 1-2 and pp. 1-3, Benetech, Inc., Montgomery, IL.
Christopher F. Blazek, The Role of Chemicals in Controlling Coal Dust Emissions, symposium, Copyright 2003, pp. 1-14, Benetech, Inc., Montgomery, IL.
Benetech, Inc., Clean & Green Process, article, pp. 1-6, Benetech, Inc.'s Technology Center, Macomb, IL.
Christopher F. Blazek, The Influence of Moisture on the Spontaneous Combustion of Coal, report, Copyright 2001, pp. 1-18, Benetech, Inc., Montgomery, IL.
Benetech, Inc., Total Dust Management Transfer Chute Services, article, pp. 1-25, Benetech, Inc., Montgomery, IL.
Why Control Dust?, article, pp. 1-2.
Sybil P. Parker, McGraw-Hill Dictionary of Scientific and Technical Terms, dictionary, Copyright 1989, pp. 1-5, Fourth Edition, McGraw-Hill Book Company, New York, N.Y.
Babcock & Wilcox, Steam/its generation and use, Copyright 1978, pp. 5-7 thru 5-8 and pp. 15-1 thru 15-26, Babcock & Wilcox, New York, N.Y.
D.K. McDonald and D.A. Madden, B&W's Advanced Coal-Fired Low Emission Boiler System Commercial Generating Unit and Proof-of-Concept Demonstration, symposium, Copyright 1997, pp. 1-9, BR-1648, Babcock & Wilcox, New York, N.Y.
Reinhardt Schuhmann, Jr., Metallurgical Engineering, book, Copyright 1952, pp. 69-108, vol. 1, Addison-Wesley Publishing Company, Inc., Reading, Massachusetts.

* cited by examiner

PREPARATION OF FUEL USABLE IN A FOSSIL-FUEL-FIRED SYSTEM

PRIORITY APPLICATION

This application is a divisional of U.S. Application No. 10/818,229, filed on Apr. 2, 2004, now abandoned, which claims priority to U.S. Provisional Application No. 60/462,552 filed Apr.11, 2003, the disclosures of which are expressly incorporated herein by reference.

FIELD OF THE INVENTION

The invention relates to a reduced-emissions fossil-fuel-fired system such as a fossil-fuel-fired furnace. In particular, the present invention is directed to reduce at least the opacity of the emissions from a fossil-fuel-fired system.

BACKGROUND OF THE INVENTION

The 1990 amendments to the United States Clean Air Act require major producers of air emissions, such as electrical power plants, to limit the discharge of airborne contaminants emitted during combustion processes. In most steam power plants in operation today, fossil fuels (such as petroleum or coal) are burned in a furnace including a boiler to heat water into steam. The steam drives turbines coupled to a generator to produce electricity. These fossil-fuel-fired furnaces, however, emit highly polluting flue-gas streams into the atmosphere. These flue-gas streams typically contain noxious gaseous chemical compounds, such as carbon dioxide, chlorine, fluorine, $NO_x$, and $SO_x$, as well as particulates, such as fly ash, which is a largely incombustible residue that remains after combustion of the fossil fuel.

To date, many devices have been used to reduce the concentration of contaminants emitted by fossil-fuel-fired furnaces. One of the most effective devices is an electrostatic precipitator (ESP). ESPs and their use in a typical fossil-fuel-fired boiler are described in detail in U.S. Pat. No. 6,488,740. An ESP is a device with evenly spaced static conductors, typically plates, which are electrostatically charged. When a flue-gas stream is passed between the conductors, particulates in the flue gas become charged and are attracted to the conductors. Typically, twenty to sixty conductors are arranged parallel to one another, and the flue-gas stream is passed through passages formed between the conductors. A layer of particulates formed on the conductors limits the strength of the electrostatic field and reduces the performance of the ESP. To maintain performance, the conductors are periodically cleaned to remove the collected particulates.

There are two types of ESPs: dry and wet. A dry ESP removes particulates from the conductors by shaking or rapping the conductors and collecting the removed particulates in a dry hopper. A wet ESP removes the particulates by washing the particulates off the conductors and collecting the removed particulates in a wet hopper.

A system for removing particulates using a series of dry ESP fields and a wet ESP field is disclosed in U.S. Pat. No. 3,444,668. This system removes particulates in a cement manufacturing process. However, positioning a wet ESP field upstream of a dry ESP field, such as that disclosed in U.S. Pat. No. 2,874,802, does not sufficiently remove contaminants from a flue-gas stream or address the above-described problems.

U.S. Pat. Nos. 5,384,343 and 5,171,781 disclose a process of pelleting coal fines with superabsorbent fines that have been aggregated for use in fossil-fuel furnaces including the steps of converting a wet sticky mass of coal fines to a crumbly or flowable solid and then pelleting the solid. The '343 and '781 patents disclose making the wet, sticky mass of coal fines with water absorbent polymer particles that are fines, particle size of less than 10 μm, that are selected from starch acrylonitrile graft copolymers and polymers formed by polymerization of water soluble ethylenically unsaturated monomer or monomer blend. In particular, the polymer particle fines have an effective dry size of less than 10 μm. The fines are then aggregated, and the aggregate polymer is made up of a mixture of superabsorbent polymers of at least 90% below 50 μm and are mixed into the mass of particulate material, while the particles are in the form either of a dry powder having a particle size above 50 μm and which consists of internally bonded friable aggregates of finer particles below 50 μm in size, or of a dispersion of particles below 50 μm in size in water immiscible liquid. In essence, the '343 and '781 patents are directed to the use of superabsorbent polymer fines, which are aggregated and used to pelletize combustion fuel such as coal.

The '343 and '781 patents further teach that the use of absorbent particles as low as 50 μm or less is therefore generally undesirable, but a tendency with the use of larger particles, e.g., 200 μm and above, is that their rate of absorption of liquid from the environment can be rather slow and, if such particles aggregate, then the aggregates are rather large, and this can be undesirable.

In view of the foregoing, it would be highly desirable to provide a fossil-fuel-fired system including an efficient system for decreasing the concentration of contaminants within a flue gas emitted by a fossil-fuel-fired furnace, while addressing the above described shortfalls of prior art systems.

SUMMARY OF THE INVENTION

The present invention meets these and other needs by providing a fossil-fuel-fired system that includes an emissions-control-agent dispenser, a furnace, an emissions monitor and, optionally, a controller. The emissions-control-agent dispenser provides a prescribed amount of organic-emissions-control agent, such as, for example, an opacity-control agent, to the fossil-fuel-fired system. The furnace includes an exhaust communicating with the atmosphere. The emissions monitor is capable of measuring at least one property of the flue-gas communicated through the exhaust to the atmosphere. For example, when an organic-emissions-control agent is an opacity-control agent, the emissions monitor has the capability of at least measuring opacity. When included, the controller communicates with at least the emissions-control-agent dispenser and the emissions monitor.

One aspect of the present invention is to provide a fossil-fuel-fired system that includes an emissions-control-agent dispenser, a furnace, and an emissions monitor. The emissions-control-agent dispenser provides a prescribed amount of organic-emissions-control agent. The emissions monitor is capable of measuring at least one property of the flue-gas communicated through an exhaust to the atmosphere.

Another aspect of the present invention is to provide an opacity-control-agent dispenser useable with a fossil-fuel-fired system. The fossil-fuel-fired system may include a furnace and may include an opacity monitor. The opacity-control-agent dispenser is capable of providing a prescribed amount of opacity-control agent. The opacity monitor is capable of measuring at least an opacity of the flue-gas communicated from the furnace through an exhaust to the atmosphere.

Still another aspect of the present invention is to provide a fossil-fuel-fired system including an opacity-control-agent dispenser, a furnace, an opacity monitor, and a controller. The opacity-control-agent dispenser is capable of providing a prescribed amount of an opacity-control agent. The opacity monitor is capable of measuring at least the opacity of the flue-gas communicated from the furnace through an exhaust to the atmosphere. The controller communicates with at least the opacity-control-agent dispenser and the opacity monitor.

An additional aspect of the present invention is to provide a method for controlling emissions from a fossil-fuel-fired system. The method includes (a) providing an amount of organic-emissions-control agent to a furnace, (b) measuring at least one property of the flue-gas communicated to the atmosphere, (c) comparing the measured value and a prescribed-set-point value of the at least one property, (d) adjusting, as appropriate, the amount of organic-emissions-control agent provided, and (e) repeating steps (b) through (d). The amount of provided organic-emissions-control agent is sufficient to control the at least one property of the flue-gas at a prescribed-set-point value. As the measured value and the prescribed-set-point value are compared, appropriate adjustments, if any, are made to the amount of organic-emissions-control agent provided so that the measured value and the prescribed-set-point value of the at least one property are substantially the same.

Another additional aspect of the present invention is to provide a method for controlling an opacity of the emissions from a fossil-fuel-fired system. The method includes the steps of (a) providing an amount of opacity control agent, (b) measuring at least the opacity of the flue-gas communicated to the atmosphere, (c) comparing the measured-opacity value and a prescribed-opacity set-point value, (d) adjusting, as appropriate, the amount of opacity-control agent provided, and (e) repeating steps (b) through (d). The amount of opacity-control agent provided is sufficient to control at least an opacity of the flue-gas at a prescribed-set-point value. As the measured-opacity value and the prescribed-set-point value are compared, appropriate adjustments, if any, are made to the amount of opacity-control agent provided so that the measure-opacity value and the prescribed-set-point value are substantially the same.

Still another additional aspect of the present invention is to provide a method for operating a fossil-fuel-fired system while controlling emission therefrom. The method includes the steps of (a) operating the fossil-fuel-fired system at a prescribed load-demand set-point value, (b) providing a prescribed amount of an opacity-control agent, (c) adjusting the prescribed load-demand set-point value to a different prescribed load-demand set-point value, (d) measuring at least the opacity of the flue-gas communicated to the atmosphere at the different prescribed load-demand set-point value, (e) comparing the measured-opacity value and the prescribed-opacity set-point value, (f) adjusting, as appropriate, the prescribed amount of opacity-control agent provided, and (g) repeating steps (c) through (f). The prescribed amount of opacity-control agent provided is sufficient to control at least an opacity of the flue-gas at a prescribed-opacity set-point value while operating at the prescribed load-demand set-point value. After the prescribed load-demand set-point value is adjusted to a different prescribed load-demand set-point value, the measured value and the prescribed-opacity set-point value are compared. Appropriate adjustments, if any, are made to the prescribed amount of opacity-control agent provided so that the measured value and the prescribed-set-point value of at least the opacity are substantially the same.

An alternative aspect of the present invention is to provide a fuel usable in a fossil-fuel-fired system to control the emissions communicated by the fossil-fuel-fired system into the atmosphere. The fuel includes at least one combustible materials and an organic-emissions-control agent. The emission-control agent is capable of interacting with one of the fuel, the combustion products of the fuel, and the fuel and combustion products so as to reduce the emission of at least one aspect of the flue-gas. In this manner, the emissions communicated by the fossil-fuel-fired system into the atmosphere are controlled.

Another alternative aspect of the present invention is to provide a fuel usable in a fossil-fuel-fired system to control the opacity of the flue-gas communicated by the fossil-fuel-fired system into the atmosphere. The fuel includes at least one fossil fuel and at least one opacity-control agent. The opacity-control agent is capable of interacting with one of the fuel, the combustion products of the fuel, and the fuel and combustion products so as to reduce the opacity of the flue-gas communicated by the fossil-fuel-fired system into the atmosphere. In this manner, at least the opacity of the flue-gas communicated by the fossil-fuel-fired system into the atmosphere is controlled.

Still another alternative aspect of the present invention is to provide an apparatus for decreasing the concentration of contaminants present in a flue-gas emitted into the atmosphere by a fossil-fuel-fired system. The apparatus includes at least one injector for introducing a superabsorbent polymer to the fossil-fuel-fired system in a flue-gas stream of the combusted fossil fuel. The apparatus may include any one of an emissions monitor, a controller, and an emissions monitor and a controller. When included, emissions monitor is downstream of the injector. Also, the emissions monitor is capable of measuring at least one property of the flue gas communicated to the atmosphere. The controller communicates with the at least one injector. The controller may communicate with the at least one injector and the emissions monitor. In either case, the controller controls the flow of the superabsorbent polymer through the at least one nozzle and into the flue gas stream to control the concentration of contaminants present in a flue gas downstream of the at least one injector.

These and other aspects, advantages, and salient features of the present invention will become apparent from the following detailed description, the accompanying drawings, and the appended claims.

DETAILED DESCRIPTION OF THE INVENTION

Figure 1A:
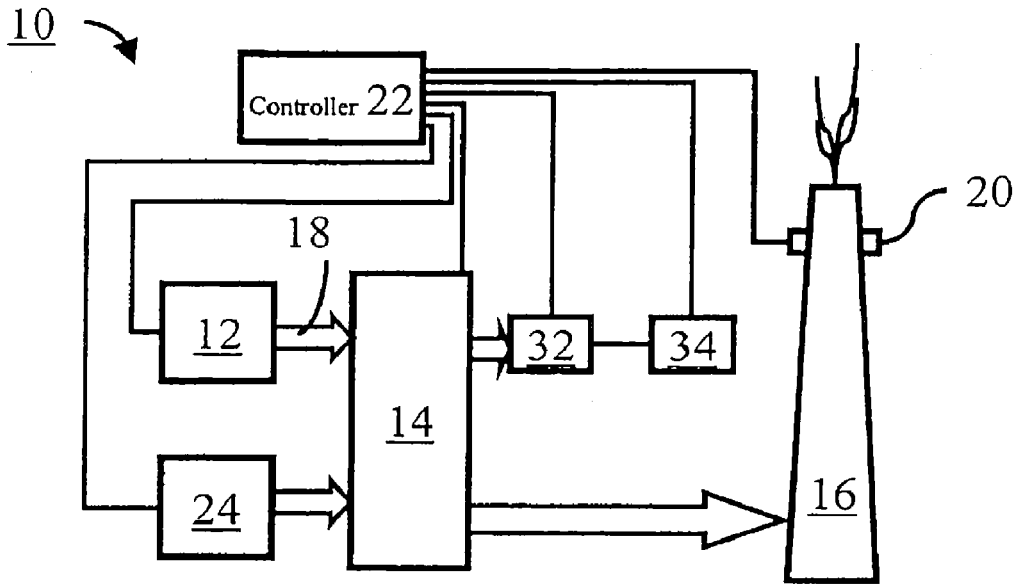
FIG. 1A depicts a schematic diagram of a fossil-fuel-fired system according to an embodiment of the present invention.

In the following description, like reference characters designate like or corresponding parts throughout the several views shown in the figures. It is also understood that terms such as "top," "bottom," "outward," "inward," and the like are words of convenience and are not to be construed as limiting terms.

Figure 1B:
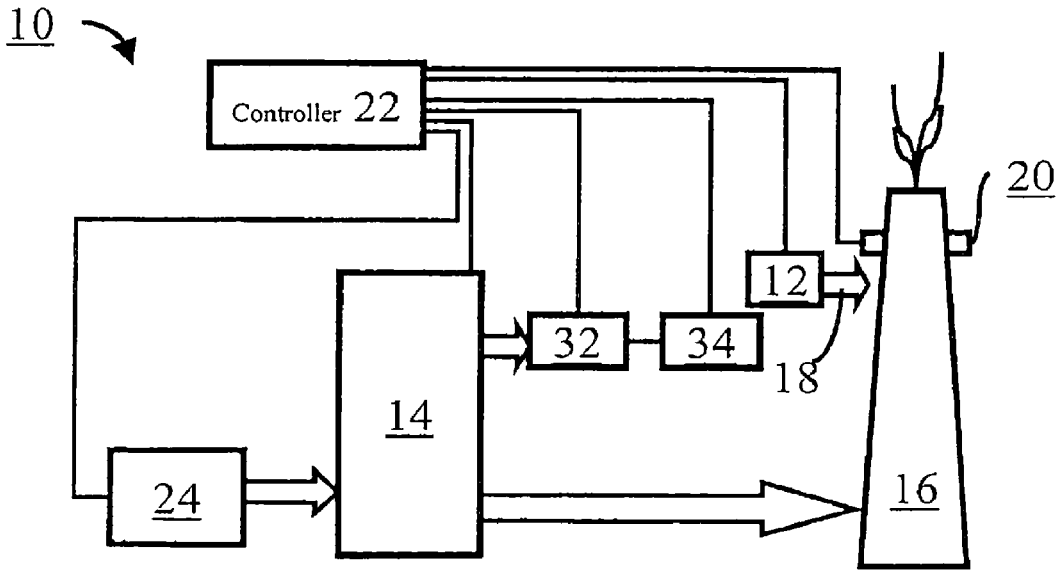
FIG. 1B depicts a schematic diagram of a fossil-fuel-fired system according to an embodiment of the present invention.
Figure 1C:
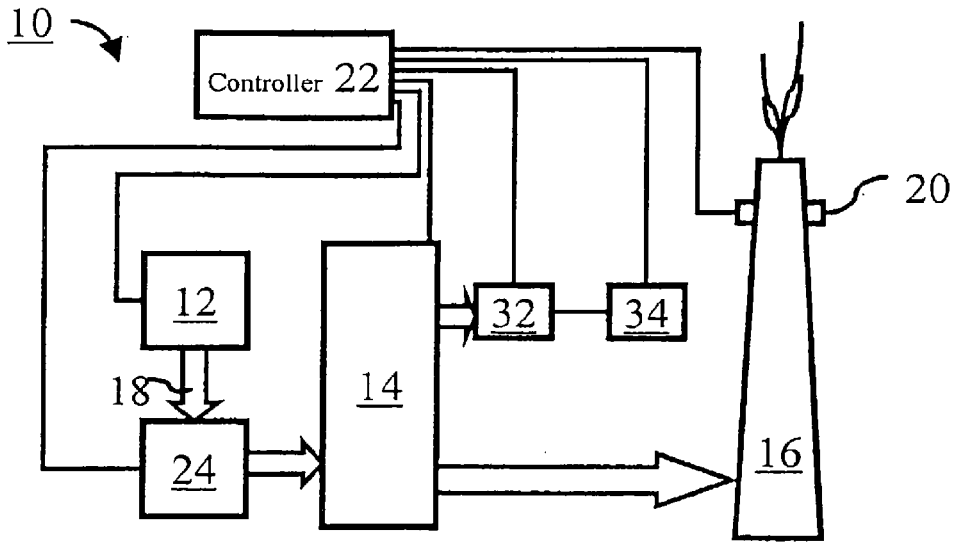
FIG. 1C depicts a schematic diagram of a fossil-fuel-fired system according to an embodiment of the present invention.
Figure 2A:
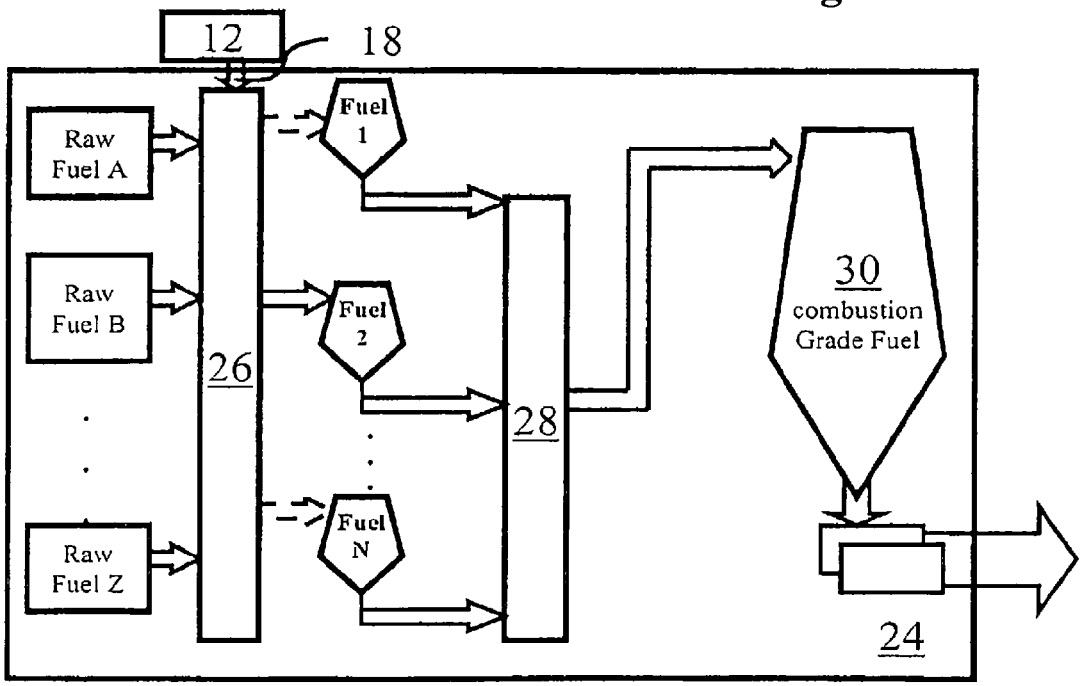
FIG. 2A depicts a schematic diagram of the details of a fuel-preparation system usable with the fossil-fuel-fired system of FIG. 1C.
Figure 2B:
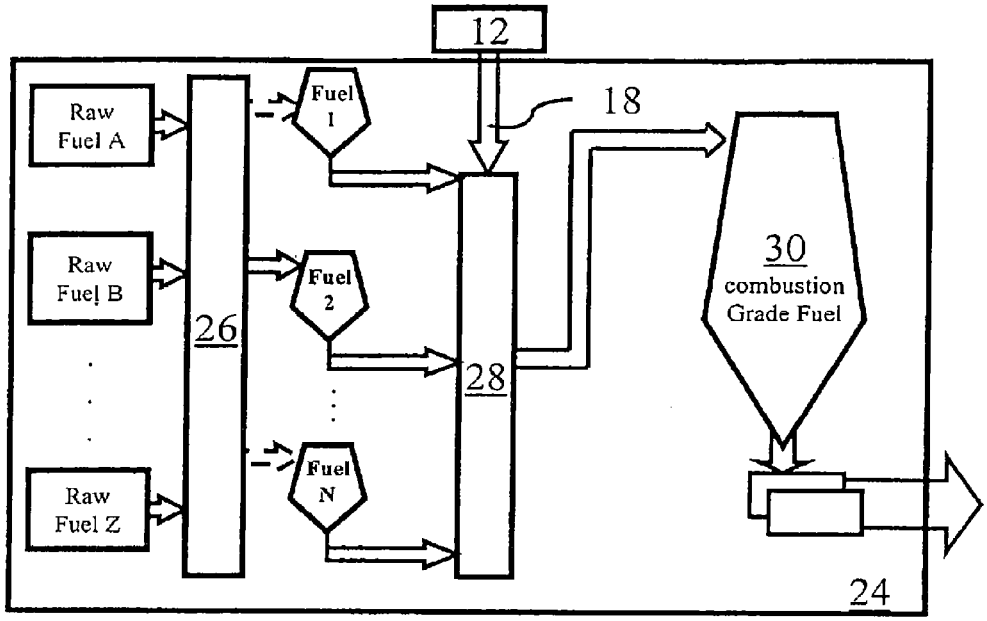
FIG. 2B depicts a schematic diagram of the details of a fuel-preparation system usable with the fossil-fuel-fired system of FIG. 1C.
Figure 2C:
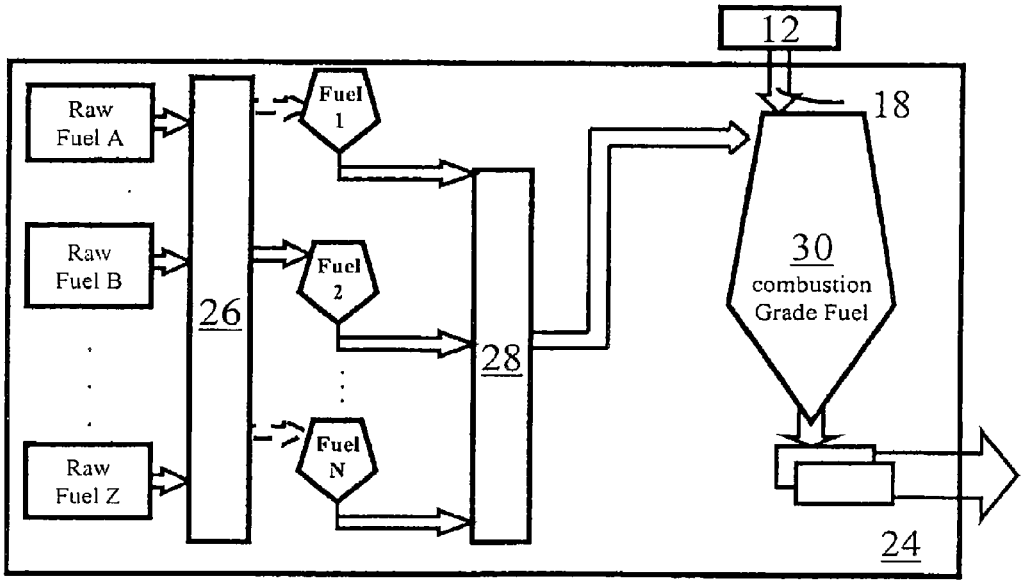
FIG. 2C depicts a schematic diagram of the details of a fuel-preparation system usable the fossil-fuel-fired system of FIG. 1C.

Referring to the drawings in general and to FIGS. 1A, 1B, and 1C in particular, it will be understood that the illustrations are for the purpose of describing embodiments of the invention and are not intended to limit the invention thereto. As best seen in FIGS. 1A, 1B, and 1C, a fossil-fuel-fired system, generally designated 10, is shown constructed according to the present invention. The fossil-fuel-fired system 10 includes an emissions-control-agent dispenser 12, a furnace 14, an emissions monitor 20, and a controller 22. The fossil-fuel-fired system 10 may include other components, such as, for example, a fossil-fuel-preparation system 24, a steam generator 32, and a power generator 34. The emissions-control-agent dispenser 12 provides an organic-emissions-control agent 18 in a prescribed manner such as, for example, any one of to the furnace 14 (as depicted in FIG. 1A), to the flue gas (as depicted in FIG. 1B), to the fossil-fuel-preparation system 24 (as depicted in FIG. 1C), to subsystems of the fossil-fuel-preparation system 24 (as depicted in FIGS. 2A, 2B, and 2C), and combinations thereof (See e.g., FIG. 4). The furnace 14 includes an exhaust 16 communicating with the atmosphere. The emissions monitor 20 is capable of measuring at least one property of the flue gas communicated from the furnace 14 through the exhaust 16 to the atmosphere. The controller 22 communicates with at least the emissions-control-agent dispenser 12 and the emissions monitor 20. As shown in FIGS. 1A, 1B, and 1C, controller 22 may communicate with the furnace 14, a fossil-fuel-preparation system 24, a steam generator 32, and a power generator 34. Not shown but implied by FIG. 3, controller 22 may communicate with a sensor and probes to facilitate the control of the fossil-fuel-fired system 10.

The controller 22 regulates an amount of emission-control agent provided by the emissions-control-agent dispenser 12. This regulation may be effected in conjunction with the emissions monitor 20 and its communication of a measured value of at least one property of the flue gas to the controller 22. For example, a prescribed amount of emission-control agent 18 is provided by the emissions-control-agent dispenser 12 to maintain at least one property of the flue gas to a predetermined limit through a feedback of the measured value from the emissions monitor 20 to the controller 22. By further example, a prescribed amount of organic-emissions-control agent 18 is provided by the emissions-control-agent dispenser 12 to maintain both at least one property to a predetermined limit and an operational load of any one of the furnace 14, the steam generator 32, the power generator 34, and combinations thereof through a feedback of the measured values to the controller 22.

The controller 22 is a commercially available controller with a plurality of inputs and outputs that meet the requirements of the peripherals. The controller 22 may be any one of a micro-controller, a PC with appropriate hardware and software, and combinations of one or more thereof. Details concerning controllers that may be used in fossil-fuel-fired system 10 are discussed in, for example, U.S. Pat. Nos. 5,980,078; 5,726,912; 5,689,415; 5,579,218; 5,351,200; 4,916,600; 4,646,223; 4,344,127; and 4,396,976, the entire disclosure of each being incorporated by reference herein.

Again with reference to FIGS. 1A, 1B, and 1C, the fossil-fuel-fired system 10 may include a fuel-preparation system 24, such as a fossil-fuel-preparation system. The fuel-preparation system 24 may be any of a variety including one of a peat-preparation system, a petroleum-coke-preparation system, a coal-preparation system, and combinations thereof. Turning now to FIGS. 2A, 2B, and 2C, the fuel-preparation system 24 may include a raw-fuel-preparation system 26 for transforming raw fuel into refined fuel. As an example, when coal is one of the raw fuels, a coal crusher may be used to transform raw coal into crushed coal.

The raw-fuel-preparation system 26 may include one or more additional dispensers. These dispensers may provide any one of a materials-handling agent, a moisture-binding agent, and a materials-handling, moisture-binding agent. Although there may be separate dispensers for each agent, in FIGS. 2A, 2B, and 2C, the agents are shown as being provided by a single dispenser, the emissions-control-agent dispenser 12.

Returning now to FIGS. 2A, 2B, and 2C, the fuel-preparation system 24 may be or include a refined-fuel-preparation system 28 for transforming refined fuel into combustion-grade fuel. As an example, when coal is one of the refined fuels, a coal pulverizer may be used to transform crushed coal into pulverized coal. As with the raw-fuel-preparation system 26, the refined-fuel-preparation system 28 may include one or more additional dispensers. These dispensers may provide any one of a materials-handling agent, a moisture-binding agent, and a materials-handling, moisture-binding agent. Also, as with the raw-fuel-preparation system 26, although there may be separate dispensers for each agent, in FIGS. 2A, 2B, and 2C, the agents are shown as being provided by a single dispenser, the emissions-control-agent dispenser 12.

The fuel-preparation system 24 may be capable of combining at least two fuels such as, for example, any one of different grades, different types, different sizes of fuel, and combinations thereof may be provided within the fossil-fuel-fired system 10. These plurality of fuels may be blended in a manner that creates a fuel mixture meeting the operational load requirements of the furnace 14, while at the same time, in combination with an organic-emissions-control agent 18, meeting or exceeding the emissions performance. It will be appreciated that when the fuel includes coal, the fuel blending may be accomplished using any one of a coal crusher (e.g., in the raw-fuel-preparation system 26), a pulverizer (e.g., in the refined-fuel-preparation system 28), and combinations thereof.

As shown in FIGS. 2A, 2B, and 2C, the raw-fuel-preparation system 26 is able to transform a plurality of raw fuels A, B, . . . , and Z into a plurality of refined fuels 1, 2, . . . , and N. Raw fuels A, B, . . . , and Z may be transformed by serially processing raw fuels A, B, . . . , and Z to produce refined fuels 1, 2, . . . , and N. Alternatively, the transformation may be achieved by drawing two or more of raw fuels A, B, . . . , and Z, for example, to sequentially produce refined fuel 1, refined fuel 2, . . . , and refined fuel N. Both processes are indicated by the solid arrow from box 26 to the refined fuel bunkers.

Also as shown in FIGS. 2A, 2B, and 2C, the refined-fuel-preparation system 26 is able to transform a plurality of refined fuels 1, 2, . . . , and N into a combustion-grade fuel. As with raw fuels A, B, . . . , and Z, refined fuels 1, 2, . . . , and N may be transformed by serially processing refined fuels 1, 2, . . . , and N to produce the combustion-grade fuel. Alternatively, the transformation may be accomplished by drawing two or more of refined fuels 1, 2, . . . , and N, for example, to sequentially produce combustion-grade fuel.

It will be appreciated that a fossil-fuel-fired system 10 may include provisions that would make it unnecessary to have a fuel-preparation system 24 to transform raw fuels and refined fuels. In such case, the fossil-fuel-fired system 10 may be a fuel-handling system 30 for providing combustion-grade fuel to the furnace 14. Is such case, the fuel-handling system 30 may include an emissions-control-agent dispenser 12 and one or more additional dispensers. These dispensers may provide any one of a materials-handling agent, a moisture-binding agent, and a materials-handling, moisture-binding agent. Although there may be separate dispensers for each agent, in FIGS. 2A, 2B, and 2C, the agents are shown as being provided by a single dispenser, the emissions-control-agent dispenser 12.

The furnace 14 may be any that would be afforded benefits by including an emissions-control-agent dispenser 12. When coal is a fuel, examples of a furnace 14 include any one of a stoker-firing furnace, a pulverized-fuel furnace, and combinations thereof. Some specific examples of a pulverized-fuel furnace include any one of a cyclone-type furnace and a fluidized-bed-type furnace. A furnace 14 may be identified by the type of fuel for which it has been designed. Thus, other examples of a furnace 14 include any one of a coal-fired furnace, a peat-fired furnace, a petroleum-coke-fired furnace, and combinations thereof. Applicants have found that providing an emissions-control-agent dispenser 12 to a coal-fired furnace to be beneficial for controlling emissions.

Returning to FIGS. 1A, 1B, and 1C, the fossil-fuel-fired system 10 may include any one of a steam generator 32 and a steam generator 32 and a power generator 34. The power generator 34 may be any of a turbine, a Sterling engine, a reciprocator steam engine, and combinations thereof.

Applicants note that the fossil-fuel-fired system 10 may be used in applications other than those depicted in FIGS. 1A, 1B, and 1C. For example, the fossil-fuel-fired system 10 may be used in applications that use any one of mechanical power, electrical power, steam power, and combinations thereof such as, for example, any one of a manufacture of pulp, a manufacture of paper, a manufacture of pulp and paper, a manufacture of textiles, a manufacture of chemicals, and a processing of rubber. Other examples of applications for a fossil-fuel-fired system 10 include the metals and cement industries such as, for example, copper-ore smelting, copper refining, nickel-ore smelting, nickel refining, zinc recovery from lead-blast-furnace slag, copper-reverberatory-furnace slag, malleable-iron production from white-cat iron, and cement production.

An emissions monitor 20 is shown in FIGS. 1A, 1B, 1C, and 4 on the exhaust 16 of the fossil-fuel-fired system 10. Such a monitor is capable of measuring at least one property of the flue gas prior to its communication into the atmosphere. Applicants have found that at least an opacity of the flue-gas is effected by the organic-emissions-control agent of the present invention. To that end, the at least one property that the emissions monitor 20 be capable of measuring is opacity. Therefore, the emissions monitor 20 may be an opacity monitor. Rather than being dedicated, the emissions monitor 20 may be flexible in that it would have the ability to measure opacity and at least an additional one property of the flue-gas such as, for example, any one of carbon oxides (e.g., CO, $CO_2$, . . . etc.), oxygen (e.g., $O_2$, $O_3$, . . . etc.), nitrogen oxides (e.g., NO, $NO_2$, $NO_x$, . . . etc.), sulfur oxides (e.g., $SO_2$, $SO_3$, $SO_x$, . . . etc.), particulate matter, flow, and combinations thereof.

Details concerning emissions monitors that may be used in a fossil-fuel-fired system 10 are discussed in, for example, U.S. Pat. Nos. 6,597,799 and 5,363,199, the entire disclosure of each being incorporated by reference herein. Continuous emission monitoring systems (CEMS), including $SO_2$ analyzers, $NO_x$ analyzers, $CO_2$ analyzers, $O_2$ analyzers, flow monitors, opacity analyzers, flue-gas flow meters, and associates data acquisition and handling systems, that meet the requirements set forth in the US Environmental Protection Agency's (EPA's) 40 CFR Part 75 are commercially available. Manufacturers of opacity monitors or analyzers include, for example Teledyne/Monitor Labs, Land Combustion, Thermo Environmental, and Durag.

Turning now to the emissions-control-agent dispenser 12 useable with a fossil-fuel-fired system 10. Any disperser that would facilitate the introduction of an organic-emissions-control agent 18 in a manner that reduces emissions communicating with the atmosphere would be appropriate. Such an emissions-control-agent dispenser 12 may include a volumetric-feed dispenser such as, for example, a screw-feed dispenser, and a mass-feed dispenser such as, for example, a weight-belt feeder.

When an opacity-control-agent dispenser, the dispenser 12 is capable of providing an opacity-control agent at a rate so that at least the opacity of the flue-gas communicated through the exhaust 16 to the atmosphere is less than or equal to a substantially prescribed value. In some jurisdictions, the opacity value is substantially less than or substantially equal to about 40. In other jurisdictions, the opacity value is substantially less than or substantially equal to about 30. In yet other jurisdictions, the opacity value is substantially less than or substantially equal to about 20. In still yet other jurisdictions, the opacity value is substantially less than or substantially equal to about 10.

An emissions-control-agent dispenser 12 may communicate with the fossil-fuel-fired system 10 in any manner that allows for providing an organic-emissions-control agent 18 so that the concentration of contaminants of a flue-gas stream emitted by an exhaust 16 are controlled. To that end, an emissions-control-agent dispenser 12 may be provided so as to communicate an organic-emissions-control agent 18 to any one of a fossil-fuel, a fossil-fuel stream prior to combustion, a fossil-fuel stream during combustion (e.g., with gases that are introduced into the furnace 14 during combustion), a fossil-fuel stream following combustion (e.g., a combusted fossil-fuel flue-gas stream), and combinations thereof.

Turning now to FIG. 1A that schematically depicts one aspect of the present invention. In this aspect, an emissions-control-agent dispenser 12 communicates an organic-emissions-control agent 18 to a furnace 14. The emissions-control-agent dispenser 12 may be or include an apparatus including, for example, at least one injector for introducing the organic-emissions-control agent 18. The communication to the furnace 14 may be by communicating an organic-emissions-control agent 18 to any one of a fossil-fuel stream prior to combustion, a fossil-fuel stream during combustion (e.g., with gases that are introduced into the furnace 14 during combustion), a fossil-fuel stream following combustion (e.g., a combusted fossil-fuel flue-gas stream), and combinations thereof.

Also as shown in FIG. 1A, an apparatus may include any one of an emissions monitor 20, a controller 22, and an emissions monitor 20 and a controller 22. When included, emissions monitor 20 is downstream of the injector. Also, the emissions monitor is capable of measuring at least one property of the combusted fossil-fuel flue-gas stream communicated to the atmosphere. The controller 20 communicates with the at least one injector. The controller 22 may communicate with the at least one injector and the emissions monitor 20. In either case, the controller 22 controls a flow of the organic-emissions-control agent 18 such as, for example, an opacity-control agent (e.g., superabsorbent polymer), through the at least one nozzle to control the concentration of contaminants present in a flue-gas stream downstream of the at least one injector. In this manner, the concentration of contaminants present in a flue-gas stream emitted by an exhaust 16 of a fossil-fuel-fired system 10 are controlled.

Turning now to FIG. 1B that schematically depicts another aspect of the present invention. In this aspect, an emissions-control-agent dispenser 12 communicates an organic-emissions-control agent 18 to an exhaust 16. The emissions-control-agent dispenser 12 may be or include an apparatus including, for example, at least one injector for introducing the organic-emissions-control agent 18. The communication to the exhaust 16 may be by communicating an organic-emissions-control agent 18 to a fossil-fuel stream following combustion (e.g., a combusted fossil-fuel flue-gas stream). As with FIG. 1A, the apparatus may include any one of an emissions monitor 20, a controller 22, and an emissions monitor 20 and a controller 22.

Turning now to FIGS. 1C, 2A, 2B, and 2C that schematically depict still another aspect of the present invention. In this aspect, an emissions-control-agent dispenser 12 communicates an organic-emissions-control agent 18 to a fuel-preparation system 24. The communication to the fuel-preparation system 24 may be by communicating an organic-emissions-control agent 18 to any one of a fossil-fuel, a fossil-fuel stream prior to combustion (e.g., any one of a raw-fuel-preparation system 26, a refined-fuel-preparation system 28, a fuel-handling system 30, and combinations thereof), and combinations thereof. The emissions-control-agent dispenser 12 in this aspect may be or include an apparatus including any one of an injector, a screw feeder, and a weight belt feeder for introducing the organic-emissions-control agent 18. As with FIGS. 1A and 1B, the apparatus may include any one of an emissions monitor 20, a controller 22, and an emissions monitor 20 and a controller 22.

Applicants have unexpectedly found that a superabsorbent polymer acts as an emissions control agent 18 in general and, in particular, as an opacity control agent. In such case, the emissions-control-agent dispenser 12 is a superabsorbent-polymer dispenser having the capability of dispensing a superabsorbent polymer having an average particle size of at least about 200 μm and even of at least about 250 μm.

Particle size characteristics for the organic-emissions-control agent useful herein may be done using standard sieve analyses. Determination of particle size characteristics using such a technique is described in greater detail in U.S. Pat. No. 5,061,259, "Absorbent structures with gelling agent and absorbent articles containing such structures" issued on Oct. 29, 1991 to Goldman, et al., the entire disclosure of which is incorporated herein by reference.

Also, the superabsorbent-polymer dispenser is capable of dispensing a superabsorbent polymer at from about 0.001 weight % to about 5 weight %, preferably, about 0.01 weight % to about 0.5 weight %, and, more preferably, at from about 0.05 weight % to about 0.25 weight % of the fuel feed to the furnace. Stated in a pound/ton-of-fuel basis, the dispenser is capable of dispensing a superabsorbent polymer at from about 0.02 pound/ton of fuel to about 100 pounds/ton, preferably, about 0.2 pound/ton of fuel to about 10 pounds/ton, and, more preferably, at from about 1 pound/ton of fuel to about 5 pounds/ton of fuel feed to the furnace. Further, the superabsorbent-polymer dispenser is capable of dispensing a superabsorbent polymer having any of a variety of physical forms including any one of particles, fibers, foams, films, beads, rods, slurries, suspensions, solutions, and combinations thereof.

Figure 3:
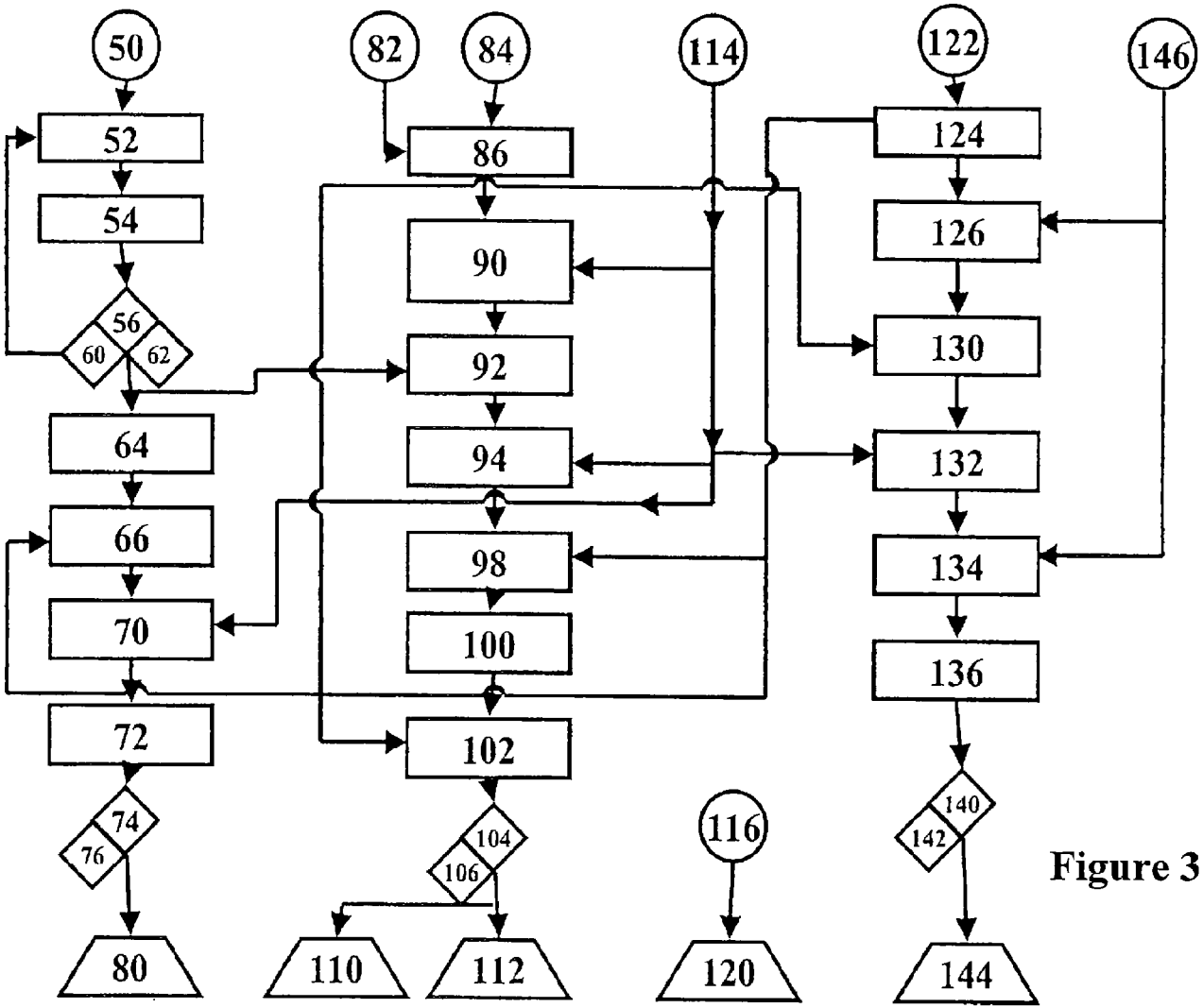
FIG. 3 is a block diagram illustrating a combustion control including emissions control useable with the fossil-fuel-fired systems of FIGS. 1A, 1B, and 1C.

FIG. 3 is a block diagram illustrating a combustion-control diagram applicable to burning at least two fuels, separately or together, in a fossil-fuel-fired system 10 capable of controlling emissions useable with any of fossil-fuel-fired system 10 of FIGS. 1A, 1B, and 1C. In FIG. 3, the similarly shaped control symbols may have a variety of consistent meanings. For example, circles may represent indicating transmitters (e.g., flow meter. level sensors, thermocouples, . . . etc.); rectangles may represent any one of a subtracting unit, a proportional controller, a proportional-plus-integral controller, and a signal lag unit; diamonds may represent manual signal generators, and when grouped may represent a hand/automatic control station including a transfer function; and trapezoids may represent a final controlling function. The specific meanings of the symbols associated with FIG. 3 are presented in the tables below.

TABLE 1

Symbol Meaning for Furnace/Boiler Portion of FIG. 3

| Element No. | Description |
|---|---|
| 50 | Steam Pressure Level |
| 52 | Pressure Level Error |
| 54 | Pressure Control |
| 56 | Transfer of a hand-automatic selector with bias (part of Boiler Master) |
| 60 | Manual signal generator of a hand-automatic selector with bias |
| 62 | Manual signal generator of a hand-automatic selector with bias |
| 64 | Fuel-Flow Cross Limit |
| 66 | Emission Level Cross Limit |
| 70 | Air-Flow Error |
| 72 | Air-Flow Control |
| 74 | Transfer a hand-automatic selector |
| 76 | Manual signal generator of a hand-automatic selector |
| 80 | Forced-Draft Fan Damper-Control Drive |

TABLE 2

Symbol Meanings for Fuel/Air Portion of FIG. 3

| Element No. | Description |
|---|---|
| 82 | Fuel B Flow |
| 84 | Fuel A Flow |
| 86 | Fuel Flow |
| 114 | Air Flow |
| 90 | Combustion Controller-Fuel/Air |
| 92 | Fuel-Flow Demand |
| 94 | Air-Flow Cross Limit |
| 98 | Emission-Level Cross Limit |
| 100 | Fuel-Flow Error |
| 102 | Fuel-Flow Control |
| 104 | Transfer a hand-automatic selector |
| 106 | Manual signal generator of a hand-automatic selector |
| 110 | Fuel A Control Valve |
| 112 | Fuel B Control Valve |

TABLE 3

Symbol Meanings for Steam-Oil Portion of FIG. 3

| Element No. | Description |
|---|---|
| 116 | Steam-Oil Pressure Differential, ΔP |
| 120 | Atomizing-Steam Valve |

TABLE 4

| Symbol Meanings for Emissions Portion of FIG. 3 | |
|---|---|
| Element No. | Description |
| 122 | Emissions Level |
| 146 | Emissions Control (EC) Agent Flow |
| 124 | Emission Error |
| 126 | Agent-Flow Cross Limit |
| 130 | Fuel-Flow Cross Limit |
| 132 | Air-Flow Cross Limit |
| 134 | EC Agent Flow Error |
| 136 | EC Agent Flow Control |
| 140 | Transfer a hand-automatic selector |
| 142 | Manual signal generator of a hand-automatic selector |
| 144 | EC Agent Disperser Drive |

As the fossil-fuel-fired system 10 includes a boiler or steam generator 32, the fuel flows, air flows, and emissions-control-agent (EC-agent) flows are controlled from steam pressure through the boiler master with the fuel and emissions readjusted from fuel-flow, air-flow, emission level, and EC-agent-flow.

Generally, FIG. 3 relates to an aspect of the present invention that provides a method for operating a fossil-fuel-fired system 10 while controlling emission therefrom. The method includes the steps of (a) operating the fossil-fuel-fired system 10 at a prescribed load-demand set-point value, (b) providing a prescribed amount of an opacity control agent 18, (c) adjusting the prescribed load-demand set-point value to a different prescribed load-demand set-point value, (d) measuring at least the opacity of the flue-gas communicated to the atmosphere, (e) comparing the measured value and the prescribed-opacity set-point value the different prescribed load-demand set-point value, (f) adjusting, as appropriate, the prescribed amount of opacity-control agent provided, and (g) repeating steps (c) through (f). The prescribed amount of opacity-control agent provided is sufficient to control at least an opacity of the flue-gas at a prescribed-opacity set-point value while operating at the prescribed load-demand set-point value. After the prescribed load-demand set-point value is adjusted to a different prescribed load-demand set-point value, the measured value and the prescribed-opacity set-point value are compared. Appropriate adjustments, if any, are made to the prescribed amount of opacity-control agent provided so that the measured value and the prescribed-set-point value of the at least the opacity are substantially the same.

Applicants have unexpectedly found that a superabsorbent polymer acts as an organic-emissions-control agent 18 in general and, in particular, as an opacity control agent. A suitable superabsorbent polymer may be selected from natural, biodegradable, synthetic, and modified natural polymers and materials. The term crosslinked used in reference to the superabsorbent polymer refers to any means for effectively rendering normally water-soluble materials substantially water-insoluble but swellable. Superabsorbent polymers include internal crosslinking and surface crosslinking.

Superabsorbent polymers are known for use in sanitary articles as well as other applications, such as for cables and fertilizers. Superabsorbent refers to a water-swellable, water-insoluble, organic or inorganic material capable of absorbing at least about 10 times its weight and up to about 30 times its weight in an aqueous solution containing 0.9 weight percent sodium chloride solution in water. A superabsorbent polymer is a crosslinked polymer which is capable of absorbing large amounts of aqueous liquids and body fluids, such as urine or blood, with swelling and the formation of hydrogels, and of retaining them under a certain pressure in accordance with the general definition of superabsorbent.

The superabsorbent polymers that are currently commercially available are crosslinked polyacrylic acids or crosslinked starch-acrylic acid graft polymers, in which some of the carboxyl groups are neutralized with sodium hydroxide solution or potassium hydroxide solution.

In one embodiment of the present invention, the superabsorbent polymer is a crosslinked polymer comprising from about 55 to about 99.9 wt. % of polymerizable unsaturated acid group containing monomers; internal crosslinking agent; and surface crosslinking agent applied to the particle surface. Such superabsorbent polymers are commercially available from Stockhausen Inc. or Stockhausen Louisiana LLC or Stockhausen GmbH & Co. KG.

The superabsorbent polymer of the present invention is obtained by the initial polymerization of from about 55 to about 99.9 wt. % of polymerizable unsaturated acid group containing monomers. Suitable monomers include those containing carboxyl groups, such as acrylic acid, methacrylic acid, or 2-acrylamido-2-methylpropanesulfonic acid, or mixtures of these monomers are preferred here. It is preferable for at least about 50-weight %, and more preferably at least about 75 wt. % of the acid groups to be carboxyl groups. It is preferred to obtain polymers obtained by polymerization of acrylic acid or methacrylic acid, the carboxyl groups of which are neutralized to the extent of 50-80 mol %, in the presence of internal crosslinking agents.

Further monomers, which can be used for the preparation of the absorbent polymers according to the invention, include about 0-40 wt. % of ethylenically unsaturated monomers that can be copolymerized with, for example, acrylamide, methacrylamide, hydroxyethyl acrylate, dimethylaminoalkyl (meth)-acrylate, ethoxylated (meth)-acrylates, dimethylaminopropylacrylamide, or acrylamidopropyltrimethylammonium chloride. More than about 40 wt. % of these monomers can impair the swellability of the polymers.

The internal crosslinking agent has at least two ethylenically unsaturated double bonds or one ethylenically unsaturated double bond and one functional group that is reactive towards acid groups of the polymerizable unsaturated acid group containing monomers or several functional groups that are reactive towards acid groups can be used as the internal crosslinking component and which is present during the polymerization of the polymerizable unsaturated acid group containing monomers.

The absorbent polymers are surface crosslinked after polymerization. Surface crosslinking is any process that increases the crosslink density of the polymer matrix in the vicinity of the superabsorbent particle surface with respect to the crosslinking density of the particle interior. The absorbent polymers are typically surface crosslinked by the addition of a surface crosslinking agent. Preferred surface crosslinking agents include chemicals with one or more functional groups, which are reactive towards pendant groups of the polymer chains, typically the acid groups. The content of the surface crosslinking agents is from about 0.01 to about 5 wt. %, and preferably from about 0.1 to about 3.0 wt. %, based on the weight of the dry polymer. A heating step is preferred after addition of the surface crosslinking agent.

While particles are the used by way of example of the physical form of superabsorbent polymers, the invention is not limited to this form and is applicable to other forms such as fibers, foams, films, beads, rods, slurries, suspensions, solutions, and the like. The average particle size of the superabsorbent polymers is at least about 200 μm and more likely at least 250 μm.

It is sometimes desirable to employ surface additives that perform several roles during surface modifications. For example, a single additive may be a surfactant, viscosity modifier and react to crosslink polymer chains.

The polymers according to the invention are preferably prepared by two methods. The polymers can be prepared continuously or discontinuously in a large-scale industrial manner by the abovementioned known process, the after-crosslinking according to the invention being carried out accordingly.

According to the first method, the partly neutralized monomer, preferably acrylic acid, is converted into a gel by free-radical polymerization in aqueous solution in the presence of crosslinking agents and, optionally, further components, and the gel is comminuted, dried, ground, and sieved off to the desired particle size. This solution polymerization can be carried out continuously or discontinuously.

Inverse suspension and emulsion polymerization can also be used for preparation of the products according to the invention. According to these processes, an aqueous, partly neutralized solution of monomers, preferably acrylic acid, is dispersed in a hydrophobic, organic solvent with the aid of protective colloids and/or emulsifiers, and the polymerization is started by free radical initiators. The internal crosslinking agents either are dissolved in the monomer solution and are metered in together with this, or are added separately and optionally during the polymerization. The addition of a water-soluble polymer as the graft base optionally takes place via the monomer solution or by direct introduction into the oily phase. The water is then removed azeotropically from the mixture, and the polymer is filtered off and, optionally, dried. Internal crosslinking can be carried out by polymerizing-in a polyfunctional crosslinking agent dissolved in the monomer solution and/or by reaction of suitable crosslinking agents with functional groups of the polymer during the polymerization steps.

In one embodiment, the superabsorbent polymer is used in the form of discrete particles. Superabsorbent polymer particles can be of any suitable shape, for example, spiral or semi-spiral, cubic, rod-like, polyhedral, etc. Particle shapes having a large greatest dimension/smallest dimension ratio, like needles, flakes, or fibers are also contemplated for use herein. Conglomerates of particles of superabsorbent polymers may also be used.

Several different superabsorbent polymers that differ, for example, in the rate of absorption, permeability, storage capacity, absorption under pressure, particle size distribution, or chemical composition can be simultaneously used together.

The polymers according to the invention are employed in many products including furnace devices such as boilers. The superabsorbent polymers can be introduced directly into the boiler or applied to coal prior to introduction of the coal into the boiler. When the superabsorbent polymer is introduced directly into the boiler, any means can be used to do so. The superabsorbent polymer may be introduced with gases that are introduced into the boiler during combustion.

When the superabsorbent polymer is applied to coal, it is usually applied to the coal in the amount of from about 0.02 to about 100 pounds of superabsorbent polymer per ton of coal, preferably, from about 0.2 to about 10 pounds of superabsorbent polymer per ton of coal, and most preferably, from about 1 to about 5 pounds of superabsorbent polymer per ton of coal. As one can appreciate, increasing the amount of superabsorbent polymer to the coal has a diminishing value on improving results in the fossil-fuel-fired furnace. In one embodiment, the superabsorbent polymer is dusted onto the coal being held in what are called bunkers and allowed to settle and absorb water or other fluids. The coal is then removed from the bunker and transported by a conveyor belt to a ball mill or other type of grinding or pulverizing equipment to make the coal into particle size suitable for combustion. Generally, the coal is milled to a particle size of from about 1 to about 10 μm, and the milled coal containing superabsorbent polymer is subsequently used as fuel. When a dispersant or coagulant or other material is being incorporated before the absorbent polymer, it is generally applied as a solution, but it can be applied in solid form if its solubility is such as to permit it to dissolve relatively rapidly within the boiler or on the coal. It is often preferred that the particle sizes and the amounts of the absorbent polymer and of the filter cake are such that the amount will be adjusted to reduce the emissions of contaminants. For instance, this is achieved by adding about 0.001% (dry on dry) of polymer particles having an average particle size of about 200 μm to coal, or injecting the superabsorbent directly into the boiler.

The amount of polymer that is applied is generally at least about 0.01% and is preferably at least about 0.5% of the weight of the coal used in the fossil-fuel-fired furnace. It is a particular advantage of the invention that, despite the unpleasant character of the wet mass, good results can be obtained with very low amounts of superabsorbent polymer, often below 0.3% or 0.4%, and often below 0. 15% or 0.2%. These amounts are of dry superabsorbent polymer based on dry particles by weight of the coal.

In an aspect, the present invention is to provide a fuel usable in a fossil-fuel-fired system 10 to control the emissions communicated by the fossil-fuel-fired system 10 into the atmosphere. The fuel includes at least one combustible material and an organic-emissions-control agent 18. The emission-control agent 18 is capable of interacting with one of the fuel, the combustion products of the fuel, and the fuel and combustion products so as to reduce the emission of at least one aspect of the flue-gas. In this manner, the emissions communicated by the fossil-fuel-fired system into the atmosphere are controlled.

In another alternative aspect, the present invention is to provide a fuel usable in a fossil-fuel-fired system 10 to control the opacity of the combustion products communicated by the fossil-fuel-fired system 10 into the atmosphere. The fuel includes at least one fossil fuel and at least one opacity-control agent. The opacity-control agent is capable of interacting with one of the fuel, the combustion products of the fuel, and the fuel and combustion products so as to reduce the opacity of the flue-gas communicated by the fossil-fuel-fired system into the atmosphere. In this manner, at least the opacity of the flue-gas communicated by the fossil-fuel-fired system into the atmosphere is controlled.

Figure 4:
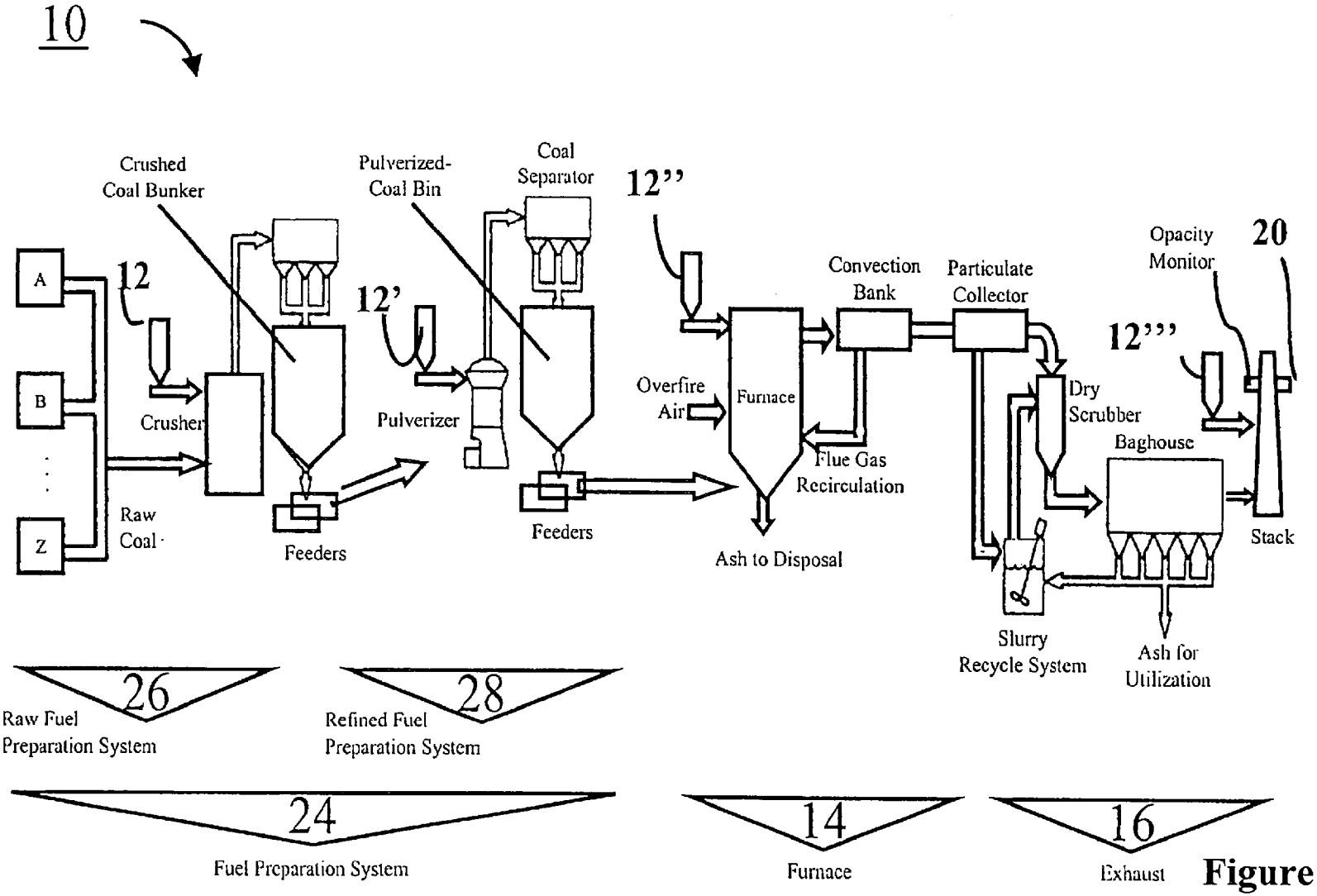
FIG. 4 depicts a detailed schematic diagram of a coal-fired system according to an embodiment of the present invention.

An operation of the fossil-fuel-fired system 10 is discussed with reference to FIG. 4, which is a schematic showing an integration of a fuel-preparation system 24 including a raw-fuel-fuel preparation system 26 and a refined-fuel-preparation system 28, a furnace 14 and an exhaust 16. A plurality of emissions-control-agent dispensers 12 are shown. The operation is discussed in the context of a coal-fired system.

Raw coal from a number of sources is processed through a dryer and crusher system (raw-fuel preparation system 26). During this processing and transport, an organic-emissions-control agent 18 may be added to the coal using a dispenser 12. Also, the coal from a number of sources may be blended by proportionally drawing coal from the number of sources simultaneously. The crushed coal is delivered to one or more bunkers. (Only one bunker is depicted in FIG. 4.)

The refined coal from the number of bunkers is processed through a pulverizing system (refined-fuel preparation system 28). During this processing and transport, if not already so done, or if additional amounts would be beneficial, an organic-emissions-control agent 18 may be added to the coal using a dispenser 12'. Also, the refined coal from the number of bunkers may be blended by proportionally drawing crushed coal and/or other fuel such as, for example, petroleum coke, from the number of bunkers simultaneously. The pulverized coal is delivered to one or more bins. (Only one bin is depicted in FIG. 4.)

The pulverized coal from the number of bins is fed through a number of burners to the furnace 14. If not already so done, or if additional amounts would be beneficial, an organic-emissions-control agent 18 may be added to the furnace 14 using a dispenser 12".

Combustion products are then passed through a convention bank, and some of the flue gas is recirculated to the furnace. The balance of the flue gas is directed through the exhaust 16 to the atmosphere. The exhaust 16 may include any one of a particulate collector, a dry scrubber, a baghouse for capturing components of the emissions, and combinations thereof. If not already so done, or if additional amounts would be beneficial, an organic-emissions-control agent 18 may be added to the exhaust 16 using a dispenser 12"'. Although depicted as being in communication with the stack, the dispenser 12"' may be in communication with any one of the particulate collector, the dry scrubber, the baghouse, the stack, and combinations thereof. An emission monitor 20 detects and reports the emissions level for the components of interest required by law.

Fossil-fuel-fired systems, as well as associated fuel-preparation systems, raw-fuel preparation systems, refined-fuel-preparation system, furnaces, exhausts, and control systems are shown in the book entitled "Steam: Its Generation and Use," 39$^{th}$ Edition, copyright by the Babcock & Wilcox Company in 1978. The description of the fossil-fuel-fired systems, as well as associated fuel-preparation systems, raw-fuel preparation systems, refined-fuel-preparation system, furnaces, exhausts, and control systems are incorporated herein by reference. Also, a fossil-fuel-fired boiler is shown in U.S. Pat. No. 6,488,740, of which the description of the boiler is incorporated by reference. Further, a fossil-fuel-fired facility is shown in the article entitled "B&W's Advance Coal-fired Low Emission Boiler System Commercial Generating Unit and Proof-of-Concept Demonstration presented to ASME International Joint Power Generation Conference" held Nov. 3-5, 1997 in Denver, Colorado, USA, of which the description of the facility is incorporated by reference.

EXAMPLE 1

The superabsorbent is applied to coal prior to processing the coal by a ball mill to have a size of 1 to 10 mm. The mix is pulverized and carried, entrained in air from the pulverizer, as a fuel into the combustion chamber of a power station boiler. There is no evidence of clogging of the pulverizer or other parts of the apparatus through which the product travels from the mixer to the boiler. It was found that the emissions of the boiler were reduced.

EXAMPLE 2

A pilot test was performed at Hoosier Energy REC, Inc.'s Ratts Generating Station in Pike County, Indiana. The coal-fired facility is able to produce 250,000 kilowatts of electricity with twin turbine generators. The generating station is equipped with environmental controls and monitors; these include precipitators for the removal of flyash. Most of the fuel for the facility is Indiana coal with moderate sulfur content burned at about 12,000 BTU per pound and mined within a radius of 20 miles of the generating station.

TABLE 5

| ENVIROSORB 1880 Technical Data | |
|---|---|
| Retention Capacity (Test Method Nr. Q3T013): | 28.5-35.0 g/g |
| Absorbency Under Load, [0.9 psi] (Test Method Nr. Q3T027): | 18.0 g/g min. |
| Particle Size: 100-850 microns (Test Method Nr. Q3T015) | |
| % on 20 Mesh [850 μm] | 2.0% Max. |
| % on 50 Mesh [300 μm] | 95% Max. |
| % on 100 Mesh [150 μm] | 30% Max. |
| % thru 100 Mesh [150 μm] | 3% Max. |
| Apparent Bulk Density (Test Method Nr. Q3T014): | 530-725 g/l |
| Moisture Content (Test Method Nr. Q3T028): | 5.0% Max |
| Residual Monomer (Test Method Nr. Q3T016): | 1000 ppm Max. |

Using a screw feeder (Model No. 105-HX, manufactured by Acrison Inc.) about 3 pounds/ton of coal of a superabsorbent polymer sold under the tradename ENVIROSORB 1880 was added before the raw coal was processed using a crusher. The Technical data relating to ENVIROSORB 1880 superabsorbent polymer is presented in Table 5 and some combustion characteristics are presented in Table 6.

TABLE 6

Combustion Characteristic of ENVIROSORB 1880

| | Results | Test method |
|---|---|---|
| Percent Ash | 39% | EPA 160.4 |
| Percent Sodium, by weight | 16% | |
| BTU/lb | 5830 BTU/lb | |
| BTU/lb | 5900-6000 BTU/lb | |
| BTU/lb | Depends on water content | |
| TCLP semi volatiles | Non detectable (<0.1 mg/l) | EPA method 8270B |
| TCLP volatiles | Below detectable (<0.05 mg/l) | EPA method |
| Reactive cyanide | Non detectable (<0.5 mg/l) | |
| Reactive sulfide | Non detectable (<25 mg/l) | |
| Arsenic | Non detectable | EPA method 6010A/7470A |
| Barium | " | EPA method 6010A/7470A |
| Cadmium | " | EPA method 6010A/7470A |
| Chromium | " | EPA method 6010A/7470A |
| Lead | " | EPA method 6010A/7470A |
| Selenium | " | EPA method 6010A/7470A |
| Silver | " | EPA method 6010A/7470A |
| Mercury | " | EPA method 6010A/7470A |

TABLE 7

Six Minute Average Data For Opacity Before, During, And After The Emissions-Control Agent Was Added To Fuel Supply

| | Hour | | | | | | |
|---|---|---|---|---|---|---|---|
| Minute | 0800–0900 | 0900–1000 | 1000–1100 | 1100–1200 | 1200–1300 | 1300–1400 | 1400–1500 |
| 01-06 | 35.7 | 37.9 | 36.2 | 33.1 | 32.7 | 31.3 | 36.2 |
| 07-12 | 37.3 | 36.7 | 35.7 | 33.2 | 33.2 | 34 | 30.5 |
| 13-18 | 36 | 38.4 | 34.1 | 33.4 | 34.2 | 32.8 | 30.7 |
| 19-24 | 43.4 | 37.4 | 35.5 | 33.5 | 34.1 | 32.5 | 29.9 |
| 25-30 | 40.1 | 35.2 | 36.2 | 32.6 | 33.1 | 31.4 | 29.7 |
| 31-36 | 38.2 | 34.6 | 40.9 | 35.7 | 36.6 | 32.5 | 30.1 |
| 37-42 | 36.3 | 38.3 | 35.6 | 34.6 | 34.4 | 30.9 | 29.6 |
| 43-48 | 35.5 | 39.8 | 36.2 | 35 | 32.8 | 33.7 | 30.3 |
| 49-54 | 34.1 | 37.2 | 33.3 | 36.2 | 32.8 | 31.3 | 30.2 |
| 55-60 | 35.6 | 37.6 | 34 | 34.9 | 32 | 31.1 | 28.6 |
| Hourly Average | 37.22 | 37.31 | 35.77 | 34.22 | 33.59 | 32.15 | 30.58 |
| Standard Deviation | 2.74 | 1.53 | 2.08 | 1.22 | 1.30 | 1.11 | 2.06 |
| Maximum Hourly Average | | 37.31 | at 0900–1000 | | | | |
| Minimum Hourly Average | | 30.58 | at 1400–1500 | | | | |
| Reduction in Opacity (%) | | 6.73 | | | | | |

| | Hour | | | | | | |
|---|---|---|---|---|---|---|---|
| Minute | 1500–1600 | 1600–1700 | 1700–1800 | 1800–1900 | 1900–2000 | 2000–2100 | 2100–2200 |
| 01-06 | 31.4 | 29.3 | 29.4 | 30.7 | 39.2 | 33.4 | 33.7 |
| 07-12 | 30.4 | 30 | 31.5 | 31.1 | 29.1 | 36.3 | 36.3 |
| 13-18 | 30.1 | 36.1 | 30.7 | 32.8 | 38.6 | 31.8 | 33.6 |
| 19-24 | 31.4 | 32.5 | 31.9 | 35.2 | 33.6 | 34.5 | 33.3 |
| 25-30 | 29.4 | 32.4 | 30.3 | 35.5 | 34.1 | 36.1 | 28.5 |
| 31-36 | 30.3 | 28 | 31.5 | 34.7 | 35.3 | 36.6 | 32.8 |
| 37-42 | 30.2 | 33.9 | 31.4 | 34 | 34.8 | 36.2 | 27.2 |
| 43-48 | 32.3 | 31.6 | 34.9 | 34.7 | 36.3 | 32.6 | 32.1 |
| 49-54 | 32.2 | 30 | 32.8 | 34.3 | 35.6 | 30.6 | 28.4 |
| 55-60 | 31.3 | 29.8 | 33.1 | 34.7 | 35.3 | 30.4 | 23.8 |
| Hourly Average | 30.9 | 31.36 | 31.75 | 33.77 | 35.19 | 33.85 | 30.97 |
| Standard Deviation | 0.96 | 2.43 | 1.56 | 1.68 | 2.79 | 2.43 | 3.82 |
| Maximum Hourly Average | | | | | | | |
| Minimum Hourly Average | | | | | | | |
| Reduction in Opacity (%) | | | | | | | |

About eight hours of coal were prepared. The opacity of the emission exhausted to the atmosphere was continuously monitored using a Spectrum 41 Continuous Opacity Monitoring System (COMS). The results of the six-minute-average data for opacity before, during, and after the superabsorbent polymer emissions-control agent was added to the fuel supply are presented in Table 7. The data demonstrate that at least the opacity of the emissions was reduced by the addition of the superabsorbent polymer emissions-control agent. Further it was believed that the plant was able to operate closer to the operational load rating without concern of reaching or exceeding the opacity limit.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A process for preparing a fuel usable in a fossil-fuel-fired system, the process comprising:

(a) processing at least one refined fuel through a pulverizing system to form a combustion-grade fuel; and (b) communicating at least a particulate superabsorbent polymer having a size less than about 850 μm at a rate of from:

(i) about 0.001 weight % to about 5 weight % of the fuel or (ii) about 0.02 pound/ton of fuel to about 100 pounds/ton of the fuel to any one of:

(α) the at least one refined fuel, (β) the combustion-grade fuel, or (γ) the at least one refined fuel and the combustion-grade fuel.

2. The process according to claim 1, further comprising blending any one of different grades of fuel, different sizes of fuel, different types of fuel, or combinations thereof.

3. The process according to claim 1, further comprising processing a raw fuel to form a refined fuel.

4. The process according to claim 3, wherein processing the raw fuel into the refined fuel comprises serially processing a plurality of raw fuels into a plurality of refined fuels.

5. The process according to claim 1, wherein processing the refined fuel to form the combustion-grade fuel comprises processing a refined coal to form a combustion-grade coal in air.

6. The process according to claim 3, wherein communicating at least a particulate superabsorbent polymer comprises communicating to any one of:

(δ) the at least one raw fuel, (α) the at least one refined fuel, (β) the combustion-grade fuel, (γ) the at least one refined fuel and the combustion-grade fuel, (ϵ) the at least one raw fuel and combustion-grade fuel, (ζ) the at least one raw fuel and at least one refined fuel, or (η) the at least one raw fuel, the at least one refined fuel, and the combustion-grade fuel.

7. The process according to claim 1, wherein the particulate superabsorbent polymer is adapted to control any one of (i) emissions, (ii) opacity, or (iii) emissions and opacity.

8. The process according to claim 1, wherein the particulate superabsorbent polymer is adapted to effect an opacity of the flue-gas communicated through the exhaust in the fossil-fuel-fired system to the atmosphere resulting in substantially less than or substantially equal to about 40.

* * * * *